US005500137A

United States Patent [19]

Bacon et al.

[11] Patent Number: 5,500,137

[45] Date of Patent: Mar. 19, 1996

[54] FABRIC SOFTENING BAR COMPOSITIONS CONTAINING FABRIC SOFTENER AND ENDURING PERFUME

[75] Inventors: Dennis R. Bacon, Milford; Toan Trinh, Maineville; Frederick A. Hartman; Robert Mermelstein, both of Cincinnati, all of Ohio

[73] Assignee: The Procter & Gamble Company, Cincinnati, Ohio

[21] Appl. No.: 326,574

[22] Filed: Oct. 20, 1994

[51] Int. Cl.[6] ..... D06M 13/00

[52] U.S. Cl. ..... 252/8.6; 252/8.7; 252/8.75; 252/8.8; 252/8.9

[58] Field of Search ..... 252/8.6, 8.7, 8.75, 252/8.8, 8.9

[56] References Cited

U.S. PATENT DOCUMENTS

| | | | |
|---|---|---|---|
| 3,947,971 | 4/1976 | Bauer | 427/242 |
| 4,299,716 | 11/1981 | Cottrell et al. | 252/174.14 |
| 4,705,644 | 11/1987 | Barone et al. | 252/174.14 |
| 5,043,091 | 8/1991 | Joshi et al. | 252/174.17 |
| 5,053,159 | 10/1991 | Joshi | 252/106 |

FOREIGN PATENT DOCUMENTS

| | | | |
|---|---|---|---|
| 2160886 | 2/1986 | United Kingdom | 252/8.8 |

OTHER PUBLICATIONS

"A Quantitative Study of Factors that Influence the Substantivity of Fragrance Chemicals on Laundered and Dried Fabrics", Escher et al., JAOCS, vol. 71, No. 1 (Jan. 1994).

"What Makes a Fragrance Substantive?", Muller et al., Givuadan–Roure Research Ltd., CH–6800 Dubendorf Switzerland (no date).

S. Archtander, "Perfume and Flavor Chemicals", (1969).

R. C. Weast, "CRC Handbook of Chemistry and Physics", 65th Edition, (1985).

*Primary Examiner*—Anthony Green

*Attorney, Agent, or Firm*—Robert B. Aylor

[57] ABSTRACT

The present invention relates to a fabric softening bar composition comprising: from about 40% to about 90% by weight of the composition of a hydrophobic fabric softening compound, from about 0.1% to about 10% of an enduring perfume composition, and optionally, but preferably, from about 5% to about 30% by weight of the composition of a nonionic surfactant, and from about 5% to about 30% by weight of the composition, water. These compositions are low sudsing, low lathering, non-detersive fabric softening compositions which provide long lasting perfume effects.

25 Claims, No Drawings

FABRIC SOFTENING BAR COMPOSITIONS CONTAINING FABRIC SOFTENER AND ENDURING PERFUME

TECHNICAL FIELD

The present invention relates to a fabric softening bar composition comprising a fabric softening compound, an efficient enduring perfume, and optionally, but preferably, nonionic surfactant and water. The composition contains naturally, and/or synthetically, derived perfumes which are substantive to fabrics. These compositions provide better perfume deposition on treated fabrics, thus minimizing the perfume lost during the laundry processes, and subsequently are not substantially lost during the rinse and drying processes. This invention also relates to a method of using this fabric softening bar composition and/or the process of making these compositions.

BACKGROUND OF THE INVENTION

In laundering it is common to treat fabrics such as cotton, polyester, etc. with fabric softening agents to render the fabrics soft to the touch, to reduce tangling, knotting or wrinkling, to render the fabrics free of static electricity, to render the fabrics bacteria-resistant, to deodorize the fabrics, and to otherwise condition the fabrics. The use of fabric conditioners also permits dried clothing to be sorted and folded more easily and quickly.

In various geographies of the world, certain consumers use detergent bars to launder their clothing without washing machines. To soften these laundered items, these consumers must soak clothing in a container so that they can add liquid softeners. In the alternative, these consumers can soften these laundered items by using a laundry bar also containing a fabric softening agent. Unfortunately the combination laundry/softening bars do not provide optimal cleaning and/or softening performance. Laundry/softener combination bars require a rinsing step after application to remove suds which potentially will remove the fabric softener actives.

Therefore, an object of the present invention is to provide a non-detersive, fabric softening bar composition to be used during or after the rinse step, preferably of a hand laundering process, which provides optimal deposition of the fabric softening actives onto fabrics and optimal softening performance.

Another object of the present invention is to provide a non-detersive fabric softening bar composition which provides improved transfer of the hydrophobic fabric softening compound from the bar composition to the fabric, especially in cold water.

A further object of the present invention is to provide a non-detersive fabric softening bar composition which provides efficient, substantive perfume delivery to fabric and an enduring perfume presence, even after the rinsing and drying steps.

SUMMARY OF THE INVENTION

The present invention relates to low sudsing, low lathering, non-detersive fabric softening bar compositions having improved softness, delivery and/or antistatic effects which provide long lasting perfume effects. These compositions comprise, as essential ingredients:

(A) from about 40% to about 90%, preferably from about 45% to about 85%, more preferably from about 50% to about 75%, and even more preferably from about 50% to about 70%, by weight of the composition, of a hydrophobic, preferably biodegradable, fabric softening compound selected from the group consisting of quaternary ammonium compounds, carboxylic acid salts of tertiary amines, carboxylic acid salts of tertiary ester amines, sorbitan esters of fatty alcohols, glycerol and polyglycerol esters, fatty amines, fatty acids, alkyl or alkenyl succinic acids, and mixtures thereof;

(B) from about 0.01% to about 10% of an enduring perfume composition;

(C) from 0%, preferably from about 5%, to about 30%, preferably from about 8% to about 25%, more preferably from about 10% to about 20%, by weight of the composition, of a nonionic surfactant selected from the group consisting of ethoxylated amines, ethoxylated alcohols, alkyl phenol ethoxylates, sorbitan esters of fatty alcohols, glycerol and polyglycerol esters, polyoxyethylene/polyoxypropylene block polymers; polyoxyethylene/polyoxypropylene block polymers of ethylene diamine, polyhydroxy fatty acid amides, amine oxides, alkylpolysaccharides, and mixtures thereof; and (D) from 0%, preferably from about 5% to about 30%, preferably from about 8% to about 25%, more preferably from about 10% to about 20%, by weight of the composition, of water;

wherein when (A) is a sorbitan ester of a fatty alcohol, glycerol ester, or a polyglycerol ester, then (C) cannot also be a sorbitan ester of a fatty alcohol, glycerol ester, or a polyglycerol ester.

Components (C) and (D) are miscible with (A) to form a new crystalline phase at room temperature, which more easily transfers to wet fabrics when rubbed against said fabrics.

All percentages and ratios used herein are by weight of the total composition unless otherwise indicated. All measurements made are at 25° C., unless otherwise designated. The invention herein can comprise, consist of, or consist essentially of, the essential components as well as the optional ingredients and components described herein.

DETAILED DESCRIPTION OF THE INVENTION

The present invention relates to low sudsing, low lathering, non-detersive fabric softening bar compositions having improved softness, delivery and/or antistatic effects which provide long lasting perfume effects. These compositions comprise, as essential ingredients:

(A) from about 40% to about 90%, preferably from about 45% to about 85%, more preferably from about 50% to about 75%, and even more preferably from about 50% to about 70%, by weight of the composition, of a hydrophobic, fabric softening compound selected from the group consisting of quaternary ammonium compounds, carboxylic acid salts of tertiary amines, carboxylic acid salts of tertiary ester amines, sorbitan esters of fatty alcohols, glycerol and polyglycerol esters, fatty amines, fatty acids, alkyl or alkenyl succinic acids, and mixtures thereof;

(B) from about 0.01% to about 10% of an enduring perfume composition;

(C) from 0%, preferably from about 5%, to about 30%, preferably from about 8% to about 25%, more preferably from about 10% to about 20%, by weight of the composition, of a nonionic surfactant selected from the group consisting of ethoxylated amines, ethoxylated alcohols, alkyl phenol ethoxylates, sorbitan esters of fatty alcohols, glycerol and polyglycerol esters, polyoxyethylene/polyoxypropylene block polymers; polyoxyethylene/polyoxypropylene block polymers of ethylene diamine, polyhydroxy fatty acid amides, amine oxides, alkylpolysaccharides, and mixtures thereof; and (D) from 0%, preferably from about 5% to about 30%, preferably from about 8% to about 25%, more preferably from about 10% to about 20%, by weight of the composition, of water;

wherein when (A) is a sorbitan ester of a fatty alcohol, glycerol ester, or a polyglycerol ester, then (C) cannot also be a sorbitan ester of a fatty alcohol, glycerol ester, or a polyglycerol ester.

Components (C) and (D) are miscible with (A) to form a new crystalline phase at room temperature, which more easily transfers to wet fabrics when rubbed against said fabrics.

The bars of the present invention preferably do not contain detersive surfactants, i.e. these bars are preferably not laundry bars or personal cleansing bars. These bars are preferably essentially free of detergent builders, anionic surfactants, soap, etc.

(A) Fabric Softening Compounds

Compositions of the present invention contain from about 40% to about 90%, preferably from about 45% to about 85%, more preferably from about 50% to about 75%, and even more preferably from about 50% to about 70%, by weight of the composition, of a fabric softening compound, preferably biodegradable, selected from the group consisting of the compounds of Formulas I, II, III, IV, V and VI, sorbitan esters of fatty alcohols, glycerol and polyglycerol esters, fatty amines, fatty acids, alkyl or alkenyl succinic acids, and mixtures thereof.

Quaternary Ammonium Compounds and Carboxylic Acid Salts of Tertiary Amines and Ester Amines The quaternary ammonium compounds and carboxylic acid salts of tertiary mines and ester amines of the present invention are selected from the group consisting of the compounds of Formulas I, II, III, IV, V, VI, and mixtures thereof.

Formula I comprises:

$$(R)_{4-m}—N^+—[(CH_2)_n—Y—R^2]_mX^- \quad (I)$$

wherein each Y is —O—(O)C—, —C(O)—O—; —NH—C(O)—; —(O)C—NH—; and mixtures thereof; preferably —O—(O)C—, —C(O)—O—; and mixtures thereof;

m is 1 to 3; preferably 2;

each n is 1 to 4; preferably 2;

each R substituent is H, a branched or straight chained $C_1$–$C_6$ alkyl group, $(C_yH_{2y}O)_wH$ where y is from 1 to 5, preferably 2 and w is from 1 to 5, preferably 3; benzyl group, and mixtures thereof; preferably a $C_1$–$C_3$, alkyl group, e.g., methyl (most preferred);

each $R^2$ is a long chain, saturated and/or unsaturated (IV of from about 3 to about 60), $C_8$–$C_{30}$ hydrocarbyl, or substituted hydrocarbyl substituent and mixtures thereof, preferably a saturated $C_{12}$–$C_{18}$ alkyl group, more preferably a saturated $C_{16}$–$C_{18}$ alkyl group; and the counterion, $X^-$, can be any softener-compatible anion, for example, methylsulfate, ethylsulfate, chloride, bromide, formate, sulfate, lactate, nitrate, benzoate, and the like, preferably methylsulfate.

It will be understood that substituents R and $R^2$ of Formula I can optionally be substituted with various groups such as alkoxyl or hydroxyl groups. The preferred compounds can be considered to be diester variations of ditallow dimethyl ammonium methyl sulfate (DTDMAMS), which is a widely used fabric softener.

Compounds of Formulas I to VI prepared with fully saturated acyl groups are excellent softeners and are preferred over unsaturated compounds described herein due to their higher melting points which can enhance bar firmness. However, compounds prepared with at least partially unsaturated acyl groups have advantages and are acceptable for consumer products when certain conditions are met.

Variables that must be adjusted to obtain the benefits of using unsaturated acyl groups include the Iodine Value (IV) of the starting fatty acids, the odor of fatty acid starting material, and/or the quaternary ammonium compound and/or amine compound. Any reference to IV values hereinafter refers to IV of fatty acyl groups and not to the resulting quaternary ammonium compound and/or amine compound.

Some highly desirable, readily available sources of fatty acids such as tallow, possess odors that remain with the quaternary ammonium compound and/or amine compound despite the chemical and mechanical processing steps which convert the raw tallow to finished quaternary ammonium compound and/or amine compound. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior static performance.

Generally, hydrogenation of fatty acids to reduce polyunsaturation and to lower the Iodine Value to insure good color and odor stability leads to a high degree of trans configuration in the molecule. Therefore, diester compounds derived from fatty acyl groups having low IV values can be made by mixing fully hydrogenated fatty acid with touch hydrogenated fatty acid at a ratio which provides an IV of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has also been found that for good chemical stability of the unsaturated diester quaternary compounds in molten storage, water levels in the raw material must be minimized to preferably less than about 1% and more preferably less than about 0.5%. Storage temperatures should be kept as low as possible while still maintaining a fluid material, ideally in the range of from about 120° F. to about 150° F. The optimum storage temperature for stability and fluidity depends on the specific IV of the fatty acid used to make the diester quaternary compound and the level/type of processing solvent selected which are described below. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of the quaternary ammonium compound of Formula I (wherein all long-chain alkyl substituents are straight-chain):

Saturated $[C_2H_5]_2{}^+N[CH_2CH_2OC(O)C_{17}H_{35}]_2\ (CH_3SO_4)^-$
$[HO-CH(CH_3)CH_2][CH_3]^+N[CH_2CH_2OC(O)C_{15}H_{31}]_2\ Br^-$
$[CH_3][C_2H_5]^+N[CH_2CH_2OC(O)C_{13}H_{27}]_2\ (HCOO)^-$
$[C_3H_7][C_2H_5]^+N[CH_2CH_2OC(O)C_{11}H_{23}]_2\ (CH_3SO_4)^-$
$[CH_3]_2{}^+N[CH_2CH_2OC(O)C_{17}H_{35}]-CH_2CH_2OC(O)C_{15}H_{31}\ (CH_3SO_4)^-$
$[CH_3]_2{}^+N[CH_2CH_2OC(O)R^2]_2\ (CH_3SO_4)^-$ where $—C(O)R^2$ is derived from saturated tallow.

A preferred compound for the bar compositions of the present invention is di(hydrogenated tallowoyloxyethyl) dimethyl ammonium chloride.

Unsaturated $[CH_3]_2{}^+N[CH_2CH_2OC(O)C_{17}H_{33}]_2\ (CH_3SO_4)^-$
$[HO-CH(CH_3)CH_2][CH_3]^+N[CH_2CH_2OC(O)C_{15}H_{29}]_2\ (HCOO)^-$
$[C_2H_5]_2{}^+N[CH_2CH_2OC(O)C_{17}H_{33}]_2\ Cl^-$
$[CH_3][C_2H_5]^+N[CH_2CH_2OC(O)C_{13}H_{25}]_2\ (C_6H_5COO)^-$
$[CH_3]_2{}^+N[CH_2CH_2OC(O)C_{17}H_{33}]-CH_2CH_2OC(O)C_{15}H_{29}\ (CH_3CH_2SO_4)^-$
$[CH_2CH_2OH][CH_3]^+N[CH_2CH_2OC(O)R^2]_2\ (CH_3SO_4)^-$
$[CH_3]_2{}^+N[CH_2CH_2OC(O)R^2]_2\ (CH_3SO_4)^-$ where $—C(O)R^2$ is derived from partially hydrogenated tallow or modified tallow having the characteristics set forth herein.

For Formula I when Y is —NH—C(O)— or —(O)C—NH— then one R is preferably $(C_yH_{2y}O)_wH$ and the other R is preferably a methyl group. These compounds known as Di(2-amidoethyl) methyl quaternary ammonium salts are disclosed in U.S. Pat No. 4,134,840, Minegishi et al., issued Jan. 16, 1979; U.S. Pat. No. 4,439,335, Bums, issued Mar. 27, 1984; and U.S. Pat. No. 4,767,547, Straathof et al., issued Aug. 30, 1988, all of which are incorporated herein by reference in their entirety.

Exemplary materials of this case are di(2-hydrogenated-tallowamidoethyl) ethoxylated (2 ethoxy groups) methylammonium methylsulfate, di(2-oleoylamidoethyl) propoxylated (3-propoxy groups) methyl ammonium bromide, di(2-palmitoleoylamidoethyl) dimethyl ammonium ethylsulfate and di(2-stearylamidoethyl) propoxylated (2 propoxy groups) methyl ammonium methylsulfate.

An exemplary commercial material suitable for use as the fabric softening compound herein is di(2-tallowamidoethyl) ethoxylated methyl ammonium methylsulfate sold under the name Varisoft® 222, from Witco Chemical Company.

Another Formula I compound in this class is methyl bis (oleyl amidoethyl) 2-hydroxyethyl ammonium methyl sulfate.

In addition to Formula I compounds, the compositions and articles of the present invention comprise quaternary ammonium compounds of Formula II:

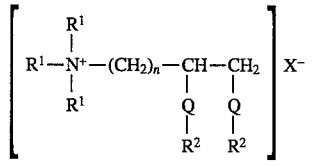

(II)

wherein, for any molecule:

each Q is —O—(O)C—, or —C(O)—O—;

each $R^1$ is branched or straight chained $C_1$–$C_6$ alkyl or hydroxy alkyl group, preferably a straight chained $C_1$–$C_4$ alkyl group;

n, $X^-$, and each $R^2$ are the same as defined hereinbefore for Formula I; and wherein preferably $R^1$ is a methyl group, n is 1, Q is —O—(O)C—;

each $R^2$ is a $C_{14}$–$C_{18}$ alkyl group, and $X^-$ is methyl sulfate.

Tallow is a convenient and inexpensive source of long chain alkyl and alkenyl materials.

A specific example of a biodegradable Formula II quaternary ammonium compound suitable for use in the fabric softening compositions herein is: 1,2-bis(tallowyl oxy)-3-trimethyl ammoniopropane methylsulfate (DTTMAPMS).

Other examples of suitable Formula II quaternary ammonium compounds of this invention are obtained by, e.g., replacing "tallowyl" in the above compounds with, for example, cocoyl, lauryl, oleyl, stearyl, palmityl, or the like;

replacing $R^1$, i.e., "methyl", in the above compounds with ethyl, propyl, isopropyl, butyl, isobutyl, t-butyl, or the hydroxy substituted analogs of these radicals;

replacing the anion $X^-$, i.e., "methylsulfate", in the above compounds with chloride, ethylsulfate, bromide, formate, sulfate, lactate, nitrate, and the like, but methylsulfate is preferred.

In addition to Formula I and Formula II compounds, the compositions and articles of the present invention comprise quaternary ammonium compounds of Formula III:

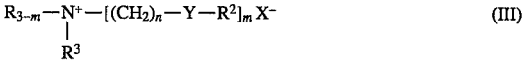

(III)

wherein $R^3$ is a $C_1$–$C_6$ hydroxyalkyl group preferably a $C_1$–$C_4$ hydroxyalkyl group;

R, n, Y, $R^2$, m, and $X^-$ are as previously defined for Formula I.

A specific example of a biodegradable Formula III compound suitable for use in the fabric softening compositions herein is N-methyl-N,N-di-(β-$C_{14}$–$C_{18}$-acyloxy ethyl), N-β-hydroxyethyl ammonium methylsulfate. A preferred compound is N-methyl, N,N-di-(2-oleyloxyethyl) N-2-hydroxyethyl ammonium methylsulfate.

These compounds are generally described in U.S. Pat. No. 3,915,867, Kang et al. issued Oct. 28, 1975, which is herein incorporated by reference in its entirety.

Preferably, Component (A) of the present invention is a biodegradable quaternary ammonium compound, i.e., a quaternary ammonium compound having at least one ester group in the long alkyl chain.

The above described compounds herein can be prepared by standard esterification and quaternization reactions, using readily available starting materials. General methods for preparation are disclosed in U.S. Pat. No. 4,137,180, incorporated herein by reference.

The fabric softening compounds of the present invention can also comprise of monoalkyl quaternary ammonium compounds, dialkyl quaternary ammonium compounds, trialkyl quaternary ammonium compounds, and mixtures thereof of Formula (IV):

$$(R)_{4-m}-N^+-[R^2]_mX^- \quad \text{(IV)}$$

wherein R, m, $R^2$, and $X^-$ are defined as hereinbefore for Formula I compound. Preferred alkyl quaternary ammonium compounds of Formula IV are variations of ditallow dimethyl ammonium chloride which is a widely used fabric softener. The fabric softening compounds of the present invention can also comprise of alkyl benzene quaternary ammonium compounds of the Formula (V):

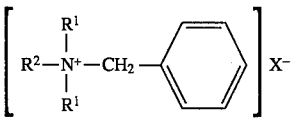

(V)

wherein $R^1$, $R^2$, and $X^-$ are as defined hereinbefore for Formula I and Formula II.

In addition to the above compounds the softening compound of the present invention can also comprise a carboxylic acid salt of a tertiary amine and/or ester amine of Formula (VI):

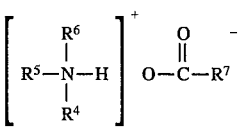

(VI)

wherein $R^5$ is a long chain aliphatic group containing from about 8 to about 30 carbon atoms; each $R^4$ and $R^6$ are selected from the group consisting of an aliphatic group containing from about 1 to about 30 carbon atoms, a hydroxyalkyl group of the formula: $R^8OH$ wherein $R^8$ is an alkylene group of from about 2 to about 30 carbon atoms, and alkyl ether groups of the formula: $R^9O(C_sH_{2s}O)_r$ wherein $R^9$ is alkyl or alkenyl group having from about 1 to about 30 carbon atoms or a hydrogen atom, s is from 1 to 5, preferably 2 or 3, and r is from about 1 to about 30; wherein $R^4$, $R^5$, $R^6$, $R^8$, and $R^9$ can be ester interrupted groups; and wherein $R^7$ is selected from the group consisting of unsubstituted alkyl, alkenyl, aryl, alkaryl and aralkyl groups having from about 8 to about 30 carbon atoms and substituted alkyl, alkenyl, aryl, alkaryl, and aralkyl of from about 1 to about 30 carbon atoms wherein the substituents are selected from the group consisting of halogen, carboxyl, and hydroxyl group, said composition having a thermal softening point of from about 35° C. to about 100° C.

This softener compound provides the following benefits: superior odor, and/or improved fabric softening performance, compared to similar compositions which utilize primary amine or ammonium compounds as the sole fabric conditioning agent. Either $R^4$, $R^5$, $R^6$, $R^7$, $R^8$, and/or $R^9$ chains can contain unsaturation.

Additionally, tertiary amine salts of carboxylic acids have superior chemical stability, compared to primary and secondary amine carboxylate salts. For example, primary and secondary amine carboxylates tend to form amides when heated, e.g., during processing. Also, they absorb carbon dioxide, thereby forming high melting carbamates which can build up as an undesirable residue on treated fabrics.

Preferably, $R^5$ is an aliphatic chain containing from about 12 to about 30 carbon atoms, $R^6$ is an aliphatic chain of from about 1 to about 30 carbon atoms, and $R^4$ is an aliphatic chain of from about 1 to about 30 carbon atoms. Particularly preferred tertiary amines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and

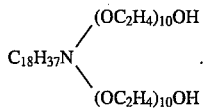

Preferred fatty acids are those wherein $R^7$ is a long chain, unsubstituted alkyl or alkenyl group of from about 8 to about 30 carbon atoms, more preferably from about 11 to about 17 carbon atoms.

Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic acid, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine myristate, stearyldimethylamine oleate, stearyldimethylamine palmitate, distearylmethylamine palmitate, distearylmethylamine laurate, tallowyldimethylamine stearate, and mixtures thereof. A particularly preferred mixture is oleyldimethylamine stearate and distearylmethylamine myristate, in a ratio of 1:10 to 10:1, preferably about 1:1.

Sorbitan Esters of Fatty Alcohols

Fabric softening compounds of the present invention also include fatty acid partial esters of polyhydric alcohols, or anhydrides thereof, wherein the alcohol or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan.

The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid.

Other nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters preferably contain from 1 to about 6 oxyethylene units, and mixtures thereof. For the purpose of the present invention, sorbitan esters containing unsaturation (e.g., sorbitan monooleate) can be utilized.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens®] are also useful in the composition of the present invention. Therefore, for purposes of the present invention, the term "sorbitan ester" includes such derivatives. An example of a preferred material is Polysorbate 61 known as Tween® 61 from ICI America.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetraesters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4-and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Other preferred sorbitan esters are disclosed in U.S. Pat. No. 4,022,938, Zaki et al., issued May 10, 1977, which is incorporated herein by reference in its entirety.

Glycerol and Polyglycerol Esters

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Preferred materials include: PEG-8 stearate known as Pegosperse® 400 MS from Glyco Corp., and PEG-200 Trihydroxystearin known as Surfactol® 590 from Chas. Chem.

The selection of the fabric softening compound will, to a great extent, determine the bar firmness properties, which are defined hereinafter.

Other Fabric Softening Compounds

The fabric softening compounds of the present invention can also comprise of $C_8$ to $C_{22}$, preferably $C_{12}$ to $C_{18}$, primary fatty amines, secondary fatty amines, tertiary fatty amines, and mixtures thereof. Preferred are $C_{12}$ to $C_{18}$ secondary and tertiary fatty amines, and mixtures thereof.

The fabric softening compounds of the present invention can also comprise of $C_8$ to $C_{22}$, preferably $C_{12}$ to $C_{18}$, fatty acids, and mixtures thereof. Preferred are $C_{12}$ to $C_{18}$ fatty acids, and mixtures thereof.

The fabric softening compounds of the present invention can also comprise of $C_8$ to $C_{22}$, preferably $C_{12}$ to $C_{18}$, alkyl or alkenyl succinic acids, and mixtures thereof. Preferred are $C_{12}$ to $C_{18}$ alkyl succinic acids, and mixtures thereof.

(B) Enduring Perfume Composition

Fabric softener compositions in the art commonly contain perfumes to provide a good odor to fabrics. These conventional perfume compositions are normally selected mainly for their odor quality, with some consideration of fabric substantivity. Typical perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference.

A substantial amount of perfume from the softening bar compositions can be lost, etiher when the fabrics are rinsed alter treatment, so that the perfume is lost with the rinse water and/or in the subsequent drying step, typically line drying. This results in both a waste of perfumes and a contribution to the general air pollution from the release of volatile organic compounds to the air.

People, skilled in the art, usually by experience, have some knowledge of some particular perfume ingredients that are "fabric substantive". Fabric substantive perfume ingredients are those odorous compounds that effectively deposit on fabrics in the laundry process and are detectable on the laundered fabrics by people with normal olfactory acuity. The knowledge on what perfume ingredients are substantive is spotty and incomplete.

We have now discovered a class of enduring perfume ingredients that can be formulated into bar fabric softener compositions and are substantially deposited and remain on fabrics throughout the rinse and drying steps. These perfume ingredients, when used in conjunction with the highly preferred rapidly biodegradable fabric softener ingredients, represent the most environmentally friendly fabric softener compositions, with minimum material waste, which still provide the good fabric feel and smell the consumers value.

These enduring perfume ingredients are characterized by their boiling points (B.P.) and their octanol/water partitioning coefficient (P). Octanol/water partitioning coefficient of a perfume ingredient is the ratio between its equilibrium concentration in octanol and in water. A perfume ingredient of this invention has a B.P., measured at the normal, standard pressure, of about 250° C. or higher, e.g., about 260° C. or higher; and an octanol/water partitioning coefficient P of about 1,000 or higher. Since the partitioning coefficients of the perfume ingredients of this invention have high values, they are more conveniently given in the form of their logarithm to the base 10, logP. Thus the perfume ingredients of this invention have logP of about 3 or higher, e.g, about 3.1, preferably about 3.2, or higher. The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach on Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

The boiling points of many perfume ingredients are given in, e.g., "Perfume and Flavor Chemicals (Aroma Chemicals)," S. Arctander, published by the author, 1969, incorporated herein by reference. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30–36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306– 316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301–310, and references cited therein, and "Predicting Physical Properties from Molecular Structure," R. Murugan et al, Chemtech, June 1994, pp. 17–23. All the above publications are incorporated herein by reference.

Thus, when a perfume composition which is composed primarily of ingredients having a B.P. at about 250° C., or higher, and a ClogP of about 3, or higher, is used in a softener composition, the perfume is very effectively deposited on fabrics and remains substantive on fabrics after the rinsing and drying, e.g., line drying step.

TABLE 1

Examples of Enduring Perfume Ingredients

| Perfume Ingredients | Approximate B.P. (°C.)(a) | ClogP |
|---|---|---|
| BP >250° C. and ClogP >3.0 | | |
| Allyl cyclohexane propionate | 267 | 3.935 |
| Ambrettolide | 300 | 6.261 |
| Amyl benzoate | 262 | 3.417 |
| Amyl cinnamate | 310 | 3.771 |
| Amyl cinnamic aldehyde | 285 | 4.324 |
| Amyl cinnamic aldehyde dimethyl acetal | 300 | 4.033 |
| iso-Amyl salicylate | 277 | 4.601 |
| Aurantiol (Trade name for Hydroxy-citronellal-methylanthranilate) | 450 | 4.216 |
| Benzophenone | 306 | 3.120 |
| Benzyl salicylate | 300 | 4.383 |
| para-tert-Butyl cyclohexyl acetate | +250 | 4.019 |
| iso-Butyl quinoline | 252 | 4.193 |
| beta-Caryophyllene | 256 | 6.333 |
| Cadinene | 275 | 7.346 |
| Cedrol | 291 | 4.530 |
| Cedryl acetate | 303 | 5.436 |
| Cedryl formate | +250 | 5.070 |
| Cinnamyl cinnamate | 370 | 5.480 |
| Cyclohexyl salicylate | 304 | 5.265 |
| Cyclamen aldehyde | 270 | 3.680 |
| Dihydro isojasmonate | +300 | 3.009 |
| Diphenyl methane | 262 | 4.059 |
| Diphenyl oxide | 252 | 4.240 |
| Dodecalactone | 258 | 4.359 |
| iso E super (Trade name for 1-(1,2,3,4,5,6,7,8-Octahydro-2,3,8,8-tetramethyl-2-naphthalenyl)-ethanone) | +250 | 3.455 |
| Ethylene brassylate | 332 | 4.554 |
| Ethyl methyl phenyl glycidate | 260 | 3.165 |
| Ethyl undecylenate | 264 | 4.888 |
| Exaltolide (Trade name for 15-Hydroxypentadecanoic acid, lactone) | 280 | 5.346 |
| Galaxolide (Trade name for 1,3,4,6,7,8-Heaxahydro-4,6,6,7,8,8-hexamethyl-cyclopenta-gamma-2-benzopyran) | +250 | 5.482 |
| Geranyl anthranilate | 312 | 4.216 |
| Geranyl phenyl acetate | +250 | 5.233 |
| Hexadecanolide | 294 | 6.805 |
| Hexenyl salicylate | 271 | 4.716 |
| Hexyl cinnamic aldehyde | 305 | 5.473 |
| Hexyl salicylate | 290 | 5.260 |
| alpha-Irone | 250 | 3.820 |
| Lilial (p-t-bucinal) (Trade name for para-tertiary-Butyl-alpha-methyl hydro-cinnamic aldehyde) | 258 | 3.858 |
| Linalyl benzoate | 263 | 5.233 |
| 2-Methoxy naphthalene | 274 | 3.235 |
| Methyl dihydrojasmone | +300 | 4.843 |
| gamma-n-Methyl ionone | 252 | 4.309 |
| Musk indanone | +250 | 5.458 |
| Musk ketone | MP = 137° C. | 3.014 |
| Musk tibetine | MP = 136° C. | 3.831 |
| Myristicin | 276 | 3.200 |
| Oxahexadecanolide-10 | +300 | 4.336 |
| Oxahexadecanolide-11 | MP = 35° C. | 4.336 |
| Patchouli alcohol | 285 | 4.530 |
| Phantolide (Trade name for 5-Acetyl-1,1,2,3,3,6-hexamethyl indan) | 288 | 5.977 |
| Phenyl ethyl benzoate | 300 | 4.058 |
| Phenylethylphenylacetate | 325 | 3.767 |
| Phenyl heptanol | 261 | 3.478 |
| Phenyl hexanol | 258 | 3.299 |
| alpha-Santalol | 301 | 3.800 |
| Thibetolide (Trade name for 15-Hydroxypentadecanoic acid, lactone) | 280 | 6.246 |
| delta-Undecalactone | 290 | 3.830 |

TABLE 1-continued

Examples of Enduring Perfume Ingredients

| Perfume Ingredients | Approximate B.P. (°C.)(a) | ClogP |
|---|---|---|
| gamma-Undecalactone | 297 | 4.140 |
| Vetiveryl acetate | 285 | 4.882 |
| Yara-yara | 274 | 3.235 |
| Ylangene | 250 | 6.268 |

(a)M.P. is melting point; these ingredients have a B.P. higher than 250° C.

Table 1 gives some non-limiting examples of enduring perfume ingredients, useful in softener compositions of the present invention. The enduring perfume compositions of the present invention contain at least about 3 different enduring perfume ingredients, more preferably at least about 4 different enduring perfume ingredients, and even more preferably at least about 5 different enduring perfume ingredients. Furthermore, the enduring perfume compositions of the present invention contain at least about 70 Wt. % of enduring perfume ingredients, preferably at least about 75 Wt. % of enduring perfume ingredients, more preferably at least about 85 Wt. % of enduring perfume ingredients. Fabric softening compositions of the present invention contain from about 0.01% to about 10%, preferably from about 0.05% to about 5%, more preferably from about 0.1% to about 4%, and even more preferably from about 0.15% to about 3%, of an enduring perfume composition.

In the perfume art, some materials having no odor or very faint odor are used as diluents or extenders. Non-limiting examples of these materials are dipropylene glycol, diethyl phthalate, triethyl titrate, isopropyl myristate, and benzyl benzoate. These materials are used for, e.g., diluting and stabilizing some other perfume ingredients. These materials are not counted in the formulation of the enduring perfume compositions of the present invention.

TABLE 2

Examples of Non-Enduring Perfume Ingredients

| Perfume Ingredients | Approximate B.P. (°C.) | ClogP |
|---|---|---|
| BP <250° C. and ClogP <3.0 | | |
| Benzaldehyde | 179 | 1.480 |
| Benzyl acetate | 215 | 1.960 |
| laevo-Carvone | 231 | 2.083 |
| Geraniol | 230 | 2.649 |
| Hydroxycitronellal | 241 | 1.541 |
| cis-Jasmone | 248 | 2.712 |
| Linalool | 198 | 2.429 |
| Nerol | 227 | 2.649 |
| Phenyl ethyl alcohol | 220 | 1.183 |
| alpha-Terpineol | 219 | 2.569 |
| BP >250° C. and ClogP <3.0 | | |
| Coumarin | 291 | 1.412 |
| Eugenol | 253 | 2.307 |
| iso-Eugenol | 266 | 2.547 |
| Indole | 254 decompos | 2.142 |
| Methyl cinnamate | 263 | 2.620 |
| Methyl dihydrojasmonate | +300 | 2.275 |
| Methyl-N-methyl anthranilate | 256 | 2.791 |
| beta-Methyl naphthyl ketone | 300 | 2.275 |
| delta-Nonalactone | 280 | 2.760 |
| Vanillin | 285 | 1.580 |
| BP <250° C. and ClogP >3.0 | | |
| iso-Bornyl acetate | 227 | 3.485 |
| Carvacrol | 238 | 3.401 |

TABLE 2-continued

Examples of Non-Enduring Perfume Ingredients

| Perfume Ingredients | Approximate B.P. (°C.) | ClogP |
|---|---|---|
| alpha-Citronellol | 225 | 3.193 |
| para-Cymene | 179 | 4.068 |
| Dihydro myrcenol | 208 | 3.030 |
| Geranyl acetate | 245 | 3.715 |
| d-Limonene | 177 | 4.232 |
| Linalyl acetate | 220 | 3.500 |
| Vertenex | 232 | 4.060 |

Non-enduring perfume ingredients, which are preferably minimized in softener compositions of the present invention, are those having a B.P. of less than about 250° C., or having a ClogP of less than about 3.0, or having both a B.P. of less than about 250° C. and a ClogP of less than about 3.0. Table 2 gives some non-limiting examples of non-enduring perfume ingredients. In some particular fabric softener compositions, some non-enduring perfume ingredients can be used in small amounts, e.g., to improve product odor. However, to minimize waste and pollution, the enduring perfume compositions of the present invention contain less than about 30 Wt. % of non-enduring perfume ingredients, preferably less than about 25 Wt. % of non-enduring perfume ingredients, more preferably less than about 20 Wt. % of non-enduring perfume ingredients, and even more preferably less than about 15 Wt. % of non-enduring perfume ingredients.

(C) Nonionic Surfactant

An optional, but highly preferred component of the present invention is a hydrophilic nonionic surfactant. These nonionic surfactants are preferably solids at room temperature with a melting point above about 25° C., preferably above about 30° C. Bar compositions of the present invention made with lower melting nonionic surfactants are generally too soft, not meeting the bar firmness requirements of the present invention.

Also, as the level of nonionic surfactant increases, i.e., above about 20% by weight of the surfactant, the bar can generally become oily.

The level of nonionic surfactant in the compositions of the present invention, when present, is typically from about 5% to about 30%, preferably from about 8% to about 25%, more preferably from about 10% to about 20%, by weight of the composition.

Suitable nonionic surfactants include addition products of ethylene oxide and, optionally, propylene oxide, with fatty alcohols, fatty acids, fatty amines, etc.

Any of the alkoxylated materials of the particular type described hereinafter can be used as the nonionic surfactant. Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 22, preferably from about 14 to about 18 carbon atoms. More preferably the hydrocarbyl chain length for liquid nonionic surfactants is from about 16 to about 18 carbon atoms and for solid nonionic surfactants is from about 10 to about 14 carbon atoms. In the general formula for the ethoxylated nonionic surfactants herein, Y is typically —O—, —C(O)O—, —C(O)N(R)—, or —C(O)N(R)R—, in which R is a short chain $C_1$–$C_6$ alkyl group, preferably a methyl or ethyl group; for solid nonionic surfactants z is at least about 7, preferably at least about 10–11, more preferably at least about 15; for liquid nonionic surfactants z is at least about 10–11, preferably at least about 15.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined.

Examples of nonionic surfactants follow. The nonionic surfactants of this invention are not limited to these examples. In the examples, the integer defines the number of ethoxyl (EO) groups in the molecule.

Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful phase modifiers in the context of this invention. Exemplary ethoxylated primary alcohols useful herein as the phase modifiers of the compositions are n-$C_{18}$EO(10); n-$C_{14}$EO(13); and n-$C_{10}$EO(11). The ethoxylates of mixed natural or synthetic alcohols in the "tallow" chain length range are also useful herein. Specific examples of such materials include tallow-alcohol-EO(11), tallowalcohol-EO(18), and tallowalcohol -EO(25).

Straight-Chain, Secondary Alcohol Alkoxylates

The deca-, undeca-, dodeca-, tetradeca-, pentadeca-, octadeca-, and nonadecaethoxylates of 3-hexadecanol, 2-octadecanol, 4-eicosanol, and 5-eicosanol having and HLB within the range recited herein are useful phase modifiers in the context of this invention. Exemplary ethoxylated secondary alcohols useful herein as the phase modifiers of the compositions are: 2-$C_{16}$EO(11); 2-$C_{20}$EO(11); and 2-$C_{16}$EO(14).

Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the phase modifiers of the instant compositions. The hexa- through octadeca-ethoxylates of p-tridecylphenol, m-pentadecylphenol, and the like, are useful herein. Exemplary ethoxylated alkylphenols useful as the phase modifiers of the mixtures herein are: p-tridecylphenol EO(11) and p-pentadecylphenol EO(18). Especially preferred is Nonyl Nonoxynol-49 known as Igepal® DM-880 from Rhone-Poulenc Inc.

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately hereinabove can be ethoxylated to an HLB within the range recited herein and used as the phase modifiers of the instant compositions.

Branched Chain Alkoxylates

Branched chain primary and secondary alcohols which are available from the well-known "OXO" process can be ethoxylated and employed as the phase modifiers of compositions herein.

The above ethoxylated nonionic surfactants are useful in the present compositions alone or in combination, and the term "nonionic surfactant" encompasses mixed nonionic surface active agents.

Sorbitan Esters of Fatty Alcohols

The nonionic surfactant of the present invention can also comprise sorbitol esters and ethoxylated sorbitol esters of fatty alcohols, described in detail hereinbefore in section (A). It is to be understood that when the nonionic surfactant comprises a sorbitol ester of a fatty alcohol, the fabric softening compound must be selected from the group of compounds listed in Section (A), other than sorbitan esters of a fatty alcohol. Conversely, when the fabric softening compound is a sorbitan ester of a fatty alcohol, then the nonionic surfactant cannot also be a sorbitol ester of a fatty alcohol.

Glycerol and Polyglycerol Esters

The nonionic surfactant of the present invention can also comprise glycerol and polyglycerol esters described in detail hereinbefore in section (A). It is to be understood that when the nonionic surfactant comprises glycerol and polyglycerol esters, the fabric softening compound must be selected from the group of compounds listed in Section (A), other than glycerol and polyglycerol esters. Conversely, when the fabric softening compound is a glycerol or polyglycerol ester, then the nonionic surfactant cannot also be a a glycerol or polyglycerol ester.

Polyethylene Oxide/Polypropylene Oxide Block Polymers

Other suitable nonionic surfactants of the present invention include polyoxyethylene/polyoxypropylene block polymers that conform generally to the formula:

$$HO(CH_2CH_2O)_x-\left[\begin{array}{c}CHCH_2O\\ |\\ CH_3\end{array}\right]_y-(CH_2CH_2O)_zH$$

wherein x and z are integers from 2 to 130; and y is an integer from 16 to 70. These compounds are known as Poloxamine and are available under the tradename of Pluracare/Pluronic® from BASF.

Still further suitable nonionic surfactants of the present invention include polyoxyethylene/polyoxypropylene block polymers of ethylene diamine that conform generally to the formula:

$$\begin{array}{l}CH_3\\ |\\ (CHCH_2O)_x(CH_2CH_2O)_yH\\ |\\ N-(CH\{CH_3\}CH_2O)_x(CH_2CH_2O)_yH\\ |\\ CH_2\\ |\\ CH_2\\ |\\ N-(CH\{CH_3\}CH_2O)_x(CH_2CH_2O)_yH\\ |\\ (CHCH_2O)_x(CH_2CH_2O)_yH\\ |\\ CH_3\end{array}$$

wherein x is an integer from 4 to 32 and y is an integer from 2 to 122. These compounds are known as Poloxamine and are available under the tradename of Tetronic® from BASF.

Polyhydroxy Fatty Acid Amides

The N-alkoxy and N-aryloxy polyhydroxy fatty acid nonionic surfactants used herein comprise amides of the formula:

$$R^2-\overset{\overset{\displaystyle O}{\|}}{C}-\overset{\overset{\displaystyle R^1}{|}}{N}-Z$$

wherein: $R^1$ is $C_2$–$C_8$ hydrocarbyl including straight-chain, branched-chain and cyclic (including aryl), and is preferably $C_2$–$C_4$ alkylene, i.e., —$CH_2CH_2$—, —$CH_2CH_2CH_2$— and —$CH_2(CH_2)_2CH_2$—; and $R^2$ is $C_1$–$C_8$ straight-chain, branched-chain and cyclic hydrocarbyl including aryl and oxy-hydrocarbyl, and is preferably $C_1$–$C_4$ alkyl or phenyl; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$— $(CHOH)_2(CHOR')(CHOH)$—$CH_2OH$, where n is an integer from 1 to 5, inclusive, and R' is H or a cyclic mono- or poly- saccharide, and alkoxylated derivatives thereof. Most preferred are glycityls wherein n is 4, particularly —$CH_2$—$(CHOH)_4$—$CH_2OH$.

In compounds of the above formula, nonlimiting examples of the amine substituent group —$R^1$—O—$R^2$ can be, for example: 2-methoxyethyl-, 3-methoxypropyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopropoxypropyl-, 2-(t-butoxy)ethyl-, 3-(t-butoxy)propyl-, 2-(isobutoxy)ethyl-, 3-(isobutoxy)propyl-, 3-butoxypropyl, 2-butoxyethyl, 2-phenoxyethyl-, methoxycyclohexyl-, methoxycyclohexylmethyl-, tetrahydrofurfuryl-, tetrahydropyranyloxyethyl-, 3-[2-methoxyethoxy]propyl-, 2-[2-methoxyethoxy]ethyl-, 3-[ 3-methoxypropoxy]propyl-, 2-[3-methoxypropoxy]

ethyl-, 3-[methoxypolyethyleneoxy]propyl-, 3-[4-methoxybutoxy]propyl-, 3-[2-methoxyisopropoxy]propyl-, $CH_3O—CH_2CH(CH_3)—$ and $CH_3OCH_2CH(CH_3)CH_2—O—(CH_2)_3—$.

$R^2—C(O)—N—$ can be, for example, cocamide, stearamide, oleamide, lauramide, myristamide, capricamide, palmitamide, tallowamide, etc.

While the synthesis of N-alkoxy or N-aryloxy polyhydroxy fatty acid amides can prospectively be conducted using various processes, contamination with cyclized by-products and other colored materials may be problematic. As an overall proposition, the synthesis method for these surfactants comprises reacting the appropriate N-alkoxy or N-aryloxy-substituted aminopolyols with, preferably, fatty acid methyl esters with or without a solvent using an alkoxide catalyst at temperatures of about 85° C. to provide products having desirable low levels (preferably, less than about 10%) of ester amide or cyclized by-products and also with improved color and improved color stability, e.g., Gardner Colors below about 4, preferably between 0 and 2. If desired, any unreacted N-alkoxy or N-aryloxy amino polyol remaining in the product can be acylated with an acid anhydride, e.g., acetic anhydride, maleic anhydride, or the like, in water at 50° C.–85° C., to minimize the overall level of such residual amines in the product. Residual sources of straight-chain primary fatty acids, which can suppress suds, can be depleted by reaction with, for example, monoethanolamine at 50° C.– 85° C.

If desired, the water solubility of the solid N-alkoxy polyhydroxy fatty acid amide surfactants herein can be enhanced by quick cooling from a melt. While not intending to be limited by theory, it appears that such quick cooling re-solidifies the melt into a metastable solid which is more soluble in water than the pure crystalline form of the N-alkoxy polyhydroxy fatty acid amide. Such quick cooling can be accomplished by any convenient means, such as by use of chilled (0° C.–10° C.) rollers, by casting the melt onto a chilled surface such as a chilled steel plate, by means of refrigerant coils immersed in the melt, or the like.

By "cyclized by-products" herein is meant the undesirable reaction by-products of the primary reaction wherein it appears that the multiple hydroxyl groups in the polyhydroxy fatty acid amides can form ring structures. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

A more detailed discussion of these materials is present in U.S. Pat. No. 5,318,728, Surutzidis et al., issued Jun. 7, 1994, which is herein incorporated by reference in its entirety.

Amine Oxides

Other suitable nonionic surfactants of the present invention include amine oxides of the formula:

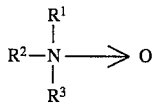

wherein each $R^1$ and $R^2$ is a short chain $C_1$–$C_4$ alkyl group, preferably a methyl group; and $R^2$ is a straight chained $C_8$–$C_{22}$ alkyl group, preferably a $C_{12}$–$C_{18}$ alkyl group.

Alkylpolysaccharides

Still further suitable nonionic surfactants of this invention include alkylpolysaccharides, preferably alkylpolyglycosides of the formula:

$$R^2O(C_nH_{2n}O)_t(Z)_x$$

wherein

Z is derived from glycose;

$R^2$ is a hydrophobic group selected from the group consisting of a $C_{10}$–$C_{18}$, preferably a $C_{12}$–$C_{14}$, alkyl group, alkyl phenyl group, hydroxyalkyl group, hydroxyalkylphenyl group, and mixtures thereof;

n is 2 or 3; preferably 2;

t is from 0 to 10; preferably 0; and x is from 1.5 to 8; preferably 1.5 to 4; more preferably from 1.6 to 2.7.

These surfactants are disclosed in U.S. Pat. No. 4,565,647, Lienado, issued Jan. 21, 1986; U.S. Pat. No. 4,536,318, Cook et al., issued Aug. 20, 1985, U.S. Pat. No. 4,536,317, Lienado et al., issued Aug. 20, 1985; U.S. Pat. No. 4,599,188, Lienado, issued Jul. 8, 1986; and U.S. Pat. No. 4,536,319, Payne, issued Aug. 20, 1985, all of which are incorporated herein by reference.

The compositions of the present invention can also comprise of mixtures of the above nonionic surfactants.

(D) Water

The bar compositions of the present invention comprise, optionally, but preferably, from about 5% to about 30%, preferably from about 8% to about 25%, more preferably from about 10% to about 20%, by weight of the composition, water. When the level of water is too high (i.e. above about 30%), the bar compositions no longer remain in a homogeneous state during processing, and a separate phase develops in the bar molds. At least some minimum level of water is essential to form the crystalline phase comprising the softening compound, nonionic surfactant and water.

The bar compositions of the present invention form a crystalline phase which comprises water, the softening compound, and the nonionic surfactant. This crystalline phase is characterized in that the composition containing this crystalline phase melts at a higher temperature than the melting point of either the starting softening compound and/or the starting nonionic surfactant. This crystalline phase is more hydrophilic than ingredient (A) alone. Therefore, the formation of this crystalline phase contributes to the excellent transferability of the composition to the fabric.

(E) Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

The bar compositions of the present invention may optionally comprise processing aids in order to lower the viscosity of the molten fabric softener mixture during processing so that the molten homogeneous mixture is more easily poured into the bar molds. These processing aids allow processing to occur at lower temperatures so that less water and perfume are lost from the bar during processing.

The compositions of the present invention can optionally comprise from about 0.1% to about 5%, preferably from about 0.5% to about 2% of a processing aid. Processing aids include salts and/or low molecular alcohols such as monohydric, dihydric (glycol, etc.), trihydric (glycerol, etc.), and polyhydric (polyols) alcohols. Especially preferred processing aids are ethanol, propylene glycol, sodium sulfate, sodium citrate, PEG 400, butane diol, and mixtures thereof.

The bar compositions of the present invention may also optionally comprise of water insoluble particulate material components, i.e., fillers. These insoluble materials include clays, talc, calcium silicates, magnesium silicate, calcium sulfate, silica, calcium phosphate, and calcium carbonate, and mixtures thereof. Preferably insoluble materials are calcium carbonate, talc and clay such as bentonite, preferably sodium bentonite. Especially preferred filler materials are those materials which also possess fabric softening properties.

Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

A more complete disclosure of these highly preferred soil release agents is contained in European Pat. Application 185,427, Gosselink, published Jun. 25, 1986, incorporated herein by reference.

Optional Cyclodextrin/Perfume Complexes and Free Perfume

The bars herein can also contain from about 0.1% to about 20%, preferably from about 1% to about 5%, cyclodextrin/perfume inclusion complexes, as disclosed in U.S. Pat. No. 5,139,687, Boreher et al., issued Aug. 18, 1992; and U.S. Pat. No. 5,234,610, Gardlik et al., issued Aug. 10, 1993, which are incorporated herein by reference. Non-enduring perfumes, as described hereinbefore, can usually benefit from protection, and can be complexed with cyclodextrin.

The free perfume ingredients and compositions of this invention are essentially the enduring perfume compositions described hereinbefore, although some conventional perfumes known in the art can also be present, especially in the cyclodextrin/perfume inclusion complex form. Selection of any perfume component, or amount of perfume, is based on aesthetic considerations. Suitable perfume compounds and compositions can be found in the art including U.S. Pat. Nos.: U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. Many of the art recognized perfume compositions are relatively substantive to maximize their odor effect on substrates. However, it is a special advantage of perfume delivery via the perfume/cyclodextrin complexes that non-enduring (nonsubstantive) perfumes are also effective.

If a product contains both free and complexed perfume, the escaped perfume from the complex contributes to the overall perfume odor intensity, thus also giving rise to a longer lasting perfume odor impression.

As disclosed in U.S. Pat. No. 5,234,610, Gardlik/Trinh/Banks/Benvegnu, issued Aug. 3, 1993, said patent being incorporated herein by reference, by adjusting the levels of free perfume and perfume/CD complex it is possible to provide a wide range of unique perfume profiles in terms of timing (release) and/or perfume identity (character).

Optional Cellulase

The cellulase usable in the compositions herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of *Humicola insolens* (*Humicola grisea* var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labeled carboxymethyl-cellulose according to the $C^{14}$CMC-method described in EPA 350,098 (incorporated herein by reference in its entirety) at $25\times10^{-6}$% by weight of cellulase protein in the laundry test solution.

Most preferred cellulases are those as described in International Patent Application WO 91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from Humicola insolens, DSM 1800, or which is homologous to said 43 kD endoglucanase.

The cellulases herein should be used in the fabric-conditioning compositions of the present invention at a level equivalent to an activity from about 1.0 to about 100 CEVU/gram of composition [CEVU=Cellulase Equivalent Viscosity Unit, as described, for example, in WO 91/13136, incorporated herein by reference in its entirety], and preferably an activity of from about 5 to about 50, more preferably from about 10 to about 25 CEVU/gram of the bar composition.

Optional Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA.

Examples of reductive agents include sodium borohydride, hypophosphorous acid, and mixtures thereof.

Other Optional Ingredients

The present invention can include other optional components (minor components) conventionally used in textile treatment compositions, for example, dyes, colorants, preservatives, optical brighteners, opacifiers, stabilizers such as guar gum, antifoam agents, silicones, and the like.

(F) Usage

The bar compositions of this invention can be used for imparting the above-described fabric treatment composition to fabric to provide softening and/or antistatic effects to fabric during or after the rinse step of the laundry process, especially a hand washing laundry process. Generally, the method of using the bar compositions of the present invention comprises: washing a bundle of fabrics or a single fabric item with an effective amount of a detergent composition, rinsing the bundle of laundered fabrics or the single item of fabric with water; and applying an effective amount of the fabric treatment bar composition to the bundle of laundered fabrics or the single item of fabric. The entire bundle of fabrics can be sorted so that only selected fabrics are softened. An effective amount of the fabric treatment bar composition is that amount which is transferred to a fabric item when the consumer rubs the bar back and forth over the fabric item for about 5 seconds to about 1 minute, preferably for about 5 seconds to about 15 seconds. Preferably the rubbing is accomplished while the fabric item is laying flat over a scrubboard. Thereafter, the fabric item is rubbed over the scrub board for about 5 seconds to about I minute, preferably for about 10 seconds to about 20 seconds, to evenly spread the composition over the fabric item. The consumer thereafter squeezes the excess water from the fabric item and hangs the fabric item to dry.

Because the consumer rubs the compositions of the present invention directly on the fabric item, excellent deposition of the softening actives occurs.

Preferably, after application of the fabric softening composition to the fabric item, the consumer does not have to re-rinse the fabric item because little or no sudsing and/or lather are formed. This, in turn, promotes greater perfume deposition.

(G) Method of Making the Bar Compositions

The bar compositions of the present invention are preferably made by the following frame process:

I. forming a homogeneous pourable molten mixture of the water, fabric softener compound, and nonionic surfactant and any non-perfume optional ingredients in a mixing vessel with stirring at a temperature of from about 50° C. (120° F.) to about 95° C. (205° F.), preferably from about 75° C. to about 95° C.;

II. adding perfume;

III. pouring or discharging the homogeneous pourable molten mixture into a bar shaped mold; and IV. crystallizing the molded molten mixture by cooling to room temperature (i.e. from about 20° C. to about 25° C.).

The bars are thereafter removed from the molds.

The process Step IV cooling can be done under refrigeration or freezing conditions.

Step I can optionally be completed under an atmosphere containing no/low water, i.e., under an inert gas such as $N_2$, especially for diester quaternary ammonium compounds.

Preferably a processing aid is added to Step I as an optional ingredient to lower the viscosity of the molten mixture so that the homogeneous mixture is more easily poured into the bar molds.

The compositions of the present invention can optionally comprise from about 0.1% to about 5%, preferably from about 0.25% to about 2% of a processing aid. Processing aids include salts and/or low molecular alcohols such as monohydric, dihydric (glycol, etc.), trihydric (glycerol, etc.), and polyhydric (polyols) alcohols. Especially preferred processing aids are ethanol, propylene glycol, sodium sulfate, sodium citrate, PEG 400, butane diol, and mixtures thereof.

The mixture of Step I comprises: from about 5% to about 30% of the water, from about 40% to about 90% of the fabric softening compound, and from about 5% to about 30% of the nonionic surfactant, with from 0.25% to about 2% of ethanol to reduce the viscosity of the molten composition.

(H) Bar Firmness

The bar firmness, i.e., strength of the structure, can be measured by the resistance to penetration of the bar using a Precision Scientific Penetrometer Probe, as measured at 25° C., having a conical needle attached to a 11 inch (22.9 cm) shaft, with standard weights of 50 grams, 100 grams, and 150 grams on top of said shaft.

The bars of the present invention have the following acceptable bar firmness characteristics as outlined in the following table (Table A):

TABLE A

| Weight in grams above the shaft of the Precision Scientific Penetrometer Probe | Acceptable Penetrometer Values |
|---|---|
| 50 grams | Up to about 8 mm, preferably up to about 7 mm, more preferably up to about 5 mm. |
| 100 grams | Up to about 10 mm, preferably up to about 8 mm, more preferably up to about 7 mm. |
| 150 grams | Up to about 12 mm, preferably up to about 10 mm, more preferably up to about 8.5 mm. |

All percentages, ratios, and parts herein, in the Specification, Examples, and claims, are by weight and are approximations unless otherwise stated.

EXAMPLES

The following examples further describe and demonstrate embodiments within the scope of the present invention. The examples given are solely for the purpose of illustration and are not to be construed as limitations of the present invention, as many variations thereof are possible without departing from the spirit and scope of the invention.

Two different perfume compositions are used in the following examples. Perfumes A and B are examples of enduring perfume compositions of this invention.

Perfume A

| Perfume Ingredients | Approximate B.P. (°C.) | ClogP | Wt. % |
|---|---|---|---|
| Benzyl salicylate | 300 | 4.383 | 20 |
| Ethylene brassylate | 332 | 4.554 | 20 |
| Galaxolide - 50%[(a)] | +300 | 5.482 | 20 |
| Hexyl cinnamic aldehyde | 305 | 5.473 | 20 |
| Tetrahydro linalool | 191 | 3.517 | 20 |
| | | Total | 100 |

[(a)]A 50% solution in benzyl benzoate. Perfume A contains about 80% of enduring perfume components having BP >250° C. and ClogP >3.0.

Perfume B

| Perfume Ingredients | Approximate B.P. (°C.) | ClogP | Wt. % |
|---|---|---|---|
| Benzyl acetate | 215 | 1.960 | 4 |
| Benzyl salicylate | 300 | 4.383 | 12 |
| Coumarin | 291 | 1.412 | 4 |
| Ethylene brassylate | 332 | 4.554 | 10 |
| Galaxolide - 50%[(a)] | +300 | 5.482 | 10 |
| Hexyl cinnamic aldehyde | 305 | 4.853 | 20 |
| Lilial | 258 | 3.858 | 15 |
| Methyl dihydro isojasmonate | +300 | 3.009 | 5 |
| gamma-n-Methyl ionone | 252 | 4.309 | 10 |
| Patchouli alcohol | 283 | 4.530 | 4 |
| Tetrahydro linalool | 191 | 3.517 | 6 |
| | | Total | 100 |

[(a)]used as a 50% solution in isopropyl myristate which is not counted in the composition. Perfume B contains about 86% of enduring perfume components having BP >250° C. and ClogP >3.0.

EXAMPLES I–III

| INGREDIENT | I (wt %) | II (wt %) | III (wt %) |
|---|---|---|---|
| Tallowyl Dimethyl Amine Stearate | 62.7 | — | — |
| DTDMAC[1] | — | 63 | — |
| Softener Compound[2] | — | — | 63 |
| Steareth-10[3] | 19 | 19 | 19 |
| Ethanol | — | 10 | 3 |
| Perfume A | 0.4 | 0.2 | 0.15 |
| Dye, Misc. | 0.51 | 0.01 | 0.01 |
| Water | 17.39 | 7.79 | 14.84 |
| Total | 100 | 100 | 100 |

[1]Ditallowdimethyl ammonium chloride available under the tradename Adogen ® 448E from Sherex Co.
[2]Di(tallowoyloxyethyl) dimethyl ammonium chloride.
[3]Polyethylene glycol ether of stearyl alcohol with approximately 10 ethylene oxide units available under the Tradename Brij ® 76 from ICI Americas.

EXAMPLES IV–VI

| INGREDIENT | IV (wt %) | V (wt %) | VI (wt %) |
|---|---|---|---|
| Tallowyl Dimethyl Amine Stearate | — | 70 | 70 |
| Sorbitan Monostearate | 63 | — | — |
| Steareth-10[1] | 19 | — | |
| Pareth-45-7[2] | — | 13 | — |
| Pareth-45-13[3] | — | — | 13 |
| Ethanol | 2 | 2 | — |
| Perfume B | 0.1 | 0.1 | 0.4 |
| Dye, Misc. | 0.01 | 0.01 | 0.46 |
| Water | 15.89 | 14.89 | 16.14 |
| Total | 100 | 100 | 100 |

[1]Polyethylene glycol ether of stearyl alcohol with approximately 10 ethylene oxide units available under the Tradename Brij ® 76 from ICI America.
[2]$C_{14}$–$C_{15}$ Pareth-7 available under the Tradename Neodol ® 45-7 from Shell Co.
[3]$C_{14}$–$C_{15}$ Pareth-13 available under the Tradename Neodol ® 45-13 from Shell Co.

EXAMPLES VII–X

| | VII (wt %) | VIII (wt %) | IX (wt %) | X (wt %) |
|---|---|---|---|---|
| Tallowyl Dimethyl Amine Stearate | 70 | 69.7 | 69.3 | 69 |
| Polysorbate 61[1] | 13 | — | — | — |
| PEG-8 Stearate[2] | — | 13 | — | — |
| PEG-200 Trihydroxystearin[3] | — | — | 13 | — |
| Nonyl Nonoxynol-49[4] | — | — | — | 13 |
| Ethanol | 2 | 2 | 2 | 2 |
| Perfume B | 0.1 | 0.4 | 0.7 | 1 |
| Dye, Misc. | 0.01 | 0.01 | 0.01 | 0.01 |
| Water | 14.89 | 14.89 | 14.89 | 14.89 |
| Total | 100 | 100 | 100 | 100 |

[1]Available under the Tradename Tween ® 61 from ICI America.
[2]Available under the Tradename Pegosperse 400 MS from Glyco Corps.
[3]Available under the Tradename Surfactol ® 590 from ChasChem.
[4]Available under the Tradename Igepal ® DM-880 from Rhone-Poulenc Inc.

The above bar compositions are made by the following process:

The fabric softening compound (tallowyldimethylamine stearate, ditallowdimethyl ammonium chloride, di(tallowoyloxyethyl) dimethyl ammonium chloride, and sorbitan monostearate), and the nonionic surfactant (i.e., Steareth-10, Pareth-45-7, Pareth 45-13, Polysorbate 61, PEG-8 stearate, PEG-200 Trihydroxy stearin, and Nonyl Nonoxynol-49) are separately melted and charged into a jacketed mixing vessel containing a paddle mixer. The mixture is kept molten at about 75°–85° C. A pre-mix of water, ethanol, and dye are heated to the same temperature and pumped to the mixing vessel under low-moderate agitation for a very short interval. Perfume is added, and a very brief period of mixing is given. The contents of the vessel are then discharged into a heated pneumatic filler and dispensed into plastic molds to form the desired shape. The solid bars are ready to be removed from the molds within 2 hours.

All of the above bars produce very low levels of suds and/or lather. The compositions transfer readily onto fabric with minimal effort. All bar compositions maintain integrity (i.e., low/no smear) when immersed in water for extended periods of time. Fabrics treated with the above bars are very soft and possess a high level of fragrance. The bars' satisfactory firmness is reflected by their acceptable penetrometer values.

What is claimed is:

1. A low sudsing, fabric softening bar composition comprising:

(A) from about 40% to about 90%, by weight of the composition, of a hydrophobic, fabric softening compound selected from the group consisting of quaternary ammonium compounds, carboxylic acid salts of tertiary amines, carboxylic acid salts of tertiary ester amines, sorbitan esters of fatty alcohols, glycerol and polyglycerol esters, fatty amines, fatty acids, alkyl or alkenyl succinic acids, and mixtures thereof;

(B) from about 0.01% to about 10% of an enduring perfume composition;

(C) optionally, from about 5% to about 30%, by weight of the composition, of a nonionic surfactant;

(D) optionally, from about 5% to about 30%, by weight of the composition, water; and;

(E) optionally, cellulase, at a level equivalent to an activity from about 1 to about 100 Cellulase Equivalent Viscosity Units/gram (CEVU/gram) of the composition;

wherein when (A) is a sorbitan ester of a fatty alcohol, glycerol ester, or a polyglycerol ester, then (C) cannot also be a sorbitan ester of a fatty alcohol, glycerol ester, or a polyglycerol ester, said composition being essentially free of detergent builders and anionic detergents.

2. The composition of claim 1 wherein said fabric softening compound is biodegradable and said nonionic surfactant is a solid with a melting point above about 25° C.

3. The composition of claim 2 wherein the nonionic surfactant is a solid with a melting point above about 30° C.

4. The composition of claim 2 wherein the enduring perfume has at least about 70% of the total weight of components with a ClogP ≧3.0 and a boiling point of ≧250° C.

5. The composition of claim 2 wherein the enduring perfume has at least about 75% of the total weight of components with a ClogP ≧3.0 and a boiling point of ≧250° C.

6. The composition of claim 2 wherein the enduring perfume has at least about 80% of the total weight of components with a ClogP ≧3.0 and a boiling point of ≧250° C.

7. The composition of claim 2 wherein the enduring perfume has at least about 85% of the total weight of components with a ClogP ≧3.0 and a boiling point of ≧250° C.

8. The composition of claim 1 wherein the enduring perfume has at least about 70% of the total weight of components with a ClogP ≧3.0 and a boiling point of ≧250° C.

9. The composition of claim 1 wherein the enduring perfume has at least about 75% of the total weight of components with a ClogP ≧3.0 and a boiling point of ≧250° C.

10. The composition of claim 1 wherein the enduring perfume has at least about 80% of the total weight of components with a ClogP ≧3.0 and a boiling point of ≧250° C.

11. The composition of claim 1 wherein the enduring perfume has at least about 85% of the total weight of components with a ClogP ≧3.0 and a boiling point of ≧250° C.

12. The composition of claim 1 wherein the level of said enduring perfume composition is from about 0.05% to about 5%.

13. The composition of claim 12 wherein the level of said enduring perfume composition is from about 0.1% to about 4%.

14. The composition of claim 13 wherein the level of said enduring perfume composition is from about 0.15% to about 3%.

15. The composition of claim 14 wherein the enduring perfume has a least about 75% of the total weight of components with a ClogP ≧3.0 and a boiling point of ≧250° C.

16. The composition of claim 15 wherein the enduring perfume has a least about 85% of the total weight of components with a ClogP ≧3.0 and a boiling point of ≧250° C.

17. The composition of claim 12 wherein the enduring perfume has a least about 75% of the total weight of components with a ClogP ≧3.0 and a boiling point of ≧250° C.

18. The composition of claim 1 wherein the nonionic surfactant is selected from the group consisting of ethoxylated amines, ethoxylated alcohols, alkyl phenol ethoxylates, sorbitan esters of fatty alcohols, glycerol and polyglycerol esters, polyoxyethylene/polyoxypropylene block polymers; polyoxyethylene/polyoxypropylene block polymers of ethylene diamine, polyhydroxy fatty acid amides, amine oxides, alkylpolysaccharides, and mixtures thereof.

19. The composition of claim 1 wherein the fabric softening compound is a carboxylic acid salt of a tertiary amine, a carboxylic acid salt of a tertiary ester amine, and mixtures thereof of the formula:

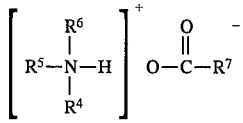

wherein $R^5$ is a long chain aliphatic group containing from about 8 to about 30 carbon atoms; each $R^4$ and $R^6$ are selected from the group consisting of an aliphatic group containing from about 1 to about 30 carbon atoms, a hydroxyalkyl group of the formula: $R^8OH$ wherein $R^8$ is an alkylene group of from about 2 to about 30 carbon atoms, an alkyl ether group of the formula: $R^9O(C_sH_{2s}O)_r$ wherein $R^9$ is alkyl or alkenyl group having from about 1 to about 30 carbon atoms or a hydrogen atom, s is from 1 to 5, and r is from about 1 to about 30, and mixtures thereof; wherein $R^4$, $R^5$, $R^6$, $R^8$, and $R^9$ can be ester interrupted groups; and wherein $R^7$ is selected from the group consisting of unsubstituted alkyl, alkenyl, aryl, alkaryl and aralkyl groups having from about 8 to about 30 carbon atoms and substituted alkyl, alkenyl, aryl, alkaryl, and aralkyl groups having from about 1 to about 30 carbon atoms, wherein the substituents are selected from the group consisting of halogen, carboxyl, and hydroxyl group.

20. The composition of claim 19 wherein the carboxylic acid salt of a tertiary amine and the carboxylic acid salt of a tertiary ester amine has a carboxylic acid salt forming anion moiety and a starting amine salt moiety, wherein the carboxylic acid salt forming anion moiety is selected from the group consisting of lauric, myristic, palmitic, stearic, oleic acid, and mixtures thereof.

21. The composition of claim 20 wherein the carboxylic acid salt of a tertiary amine and ester amine is selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine palmitate, distearylmethylamine laurate, dioleyldistearylmethylamine oleate, distearylmethylamine oleate, tallowyldimethylamine stearate, and mixtures thereof.

22. The composition of claim 1 wherein the fabric softening compound is a quaternary ammonium compound selected from the group consisting of:

$$(R)_{4-m}—N^+—[(CH_2)_n—Y—R^2]_mX^- \quad (I)$$

$$(R)_{4-m}—N^+—[R^2]_mX^- \quad (IV)$$

and mixtures thereof and wherein:

each Y is —O—(O)C—, —C(O)—O—; —NH—C(O)—; —(O)C—NH—; and mixtures thereof;

m is 1 to 3;

each n is 1 to 4;

each R substituent is H, a branched or straight chained $C_1$–$C_6$ alkyl group, $(C_yH_{2y}O)_wH$ where y is from 1 to 5, and w is from 1 to 5; benzyl group, and mixtures thereof;

each $R^2$ is a long chain, saturated or unsaturated (Iodine Value of from about 3 to about 60), $C_8$–$C_{30}$ hydrocarbyl, or substituted hydrocarbyl substituent and mixtures thereof, and the counterion, $X^-$, can be any softener-compatible anion.

23. The composition of claim 22 wherein:

each Y is —O—(O)C—, —C(O)—O—; and mixtures thereof;

m is 2;

each n is 2;

each R substituent is a $C_1$–$C_3$, alkyl group;

each $R^2$ is a saturated $C_{12}$–$C_{18}$ alkyl group.

24. The composition of claim 1 wherein said enduring perfume composition contains at least 70% of materials selected from the group consisting of: Allyl cyclohexane propionate; Ambrettolide; Amyl benzoate; Amyl cinnamate; Amyl cinnamic aldehyde; Amyl cinnamic aldehyde dimethyl acetal; iso-Amyl salicylate; Hydroxycitronellal-methylanthranilate; Benzophenone; Benzyl salicylate; para-tert-Butyl cyclohexyl acetate; iso-Butyl quinoline; beta-Caryophyllene; Cadinene; Cedrol; Cedryl acetate; Cedryl formate; Cinnamyl cinnamate; Cyclohexyl salicylate; Cyclamen aldehyde; Dihydro isojasmonate; Diphenyl methane; Diphenyl oxide; Dodecalactone; 1-(1,2,3,4,5,6,7,8-Octahydro-2,3,8,8-tetramethyl-2-naphthalenyl)-ethanone; Ethylene brassylate; Ethylmethyl phenyl glycidate; Ethyl undecylenate; 15-Hydroxypentadecanoic acid, tactone; 1,3,4,6,7,8-Hexahydro-4,6,6,7,8,8-hexamethylcyclopenta-gamma- 2-benzopyran; Geranyl anthranilate; Geranyl phenyl acetate; Hexadecanolide; Hexenyl salicylate; Hexyl cinnamic aldehyde; Hexyl salicylate; alpha-Irone; para-tertiary-Butyl-alpha-methyl hydrocinnamic aldehyde; Linalyl benzoate; 2-Methoxy naphthalene; Methyl dihydrojasmone; gamma-n-Methyl ionone; Musk indanone; Musk ketone; Musk tibetine; Myristicin; Oxahexadecanolide-10; Oxahexadecanolide-11; Patchouli alcohol; 5-Acetyl-1,1,2,3,3,6-hexamethyl indan; Phenyl ethyl benzoate; Phenylethylphenylacetate; Phenyl heptanol; Phenyl hexanol; alpha-Santalol; 15-Hydroxypentadecanoic acid, lactone; delta-Undecalactone; gamma-Undecalactone; Vetiveryl acetate; yara-yara; Ylangene; and mixtures thereof.

25. A method of conditioning fabrics in a laundering process comprising a wash cycle which comprises a wash step and a rinsing step, wherein an effective amount of the bar composition of claim 1 sufficient to soften said fabrics, is contacted with said fabrics after the wash cycle.

* * * * *